US006879696B1

(12) United States Patent
Vonlanthen

(10) Patent No.: US 6,879,696 B1
(45) Date of Patent: Apr. 12, 2005

(54) IN-EAR HEARING AID AND METHOD FOR ITS MANUFACTURE

(75) Inventor: Andi Vonlanthen, Remetschwil (CH)

(73) Assignee: Phonak AG, Stafa (CH)

( * ) Notice: Subject to any disclaimer, the term of this patent is extended or adjusted under 35 U.S.C. 154(b) by 220 days.

(21) Appl. No.: 09/588,366

(22) Filed: Jun. 6, 2000

(51) Int. Cl.[7] ..... H04R 25/00

(52) U.S. Cl. ..... 381/322; 381/325; 381/328; 181/132; 181/135

(58) Field of Search ..... 381/322, 324, 381/328, 325, 312, FOR 135; 181/132, 134, 135, 130

(56) References Cited

U.S. PATENT DOCUMENTS 5,881,159 A 3/1999 Aceti et al.
6,164,409 A * 12/2000 Berger ..... 128/864
6,359,993 B2 * 3/2002 Brimhall ..... 381/328
6,393,130 B1 * 5/2002 Stonikas et al. ..... 381/322

FOREIGN PATENT DOCUMENTS

| | | |
|---|---|---|
| EP | 0 540 862 A2 | 3/1993 |
| EP | 0 835 042 A2 | 4/1998 |
| WO | WO 99/39548 | 8/1999 |
| WO | WO 00/27166 | 3/2000 |

* cited by examiner

*Primary Examiner*—Curtis Kuntz
*Assistant Examiner*—Brian Ensey
(74) *Attorney, Agent, or Firm*—Pearne & Gordon LLP

(57) ABSTRACT

An in-the-ear hearing aid having an electric/acoustic transducer system and a freely vibrating membrane in acoustic communication with the hearing aid transducer and the hearing aid surroundings. The membrane seals the hearing aid from its surroundings to aid in protecting the hearing aid from dirt and debris.

24 Claims, 4 Drawing Sheets

IN-EAR HEARING AID AND METHOD FOR ITS MANUFACTURE

BACKGROUND OF THE INVENTION

The present invention relates to an in-ear hearing aid comprising an electric/acoustic transducer system as defined in the preamble of claim 1. The invention furthermore relates to a method for manufacturing an in-ear hearing aid as claimed in the preamble of claim 9.

Soiling is a problem in in-ear hearing aids, in particular as regards the acoustic device's output facing the ear drum. Such soiling degrades hearing-aid operation and requires periodic cleaning. The conventionally used aperture in the hearing aid housing used as acoustic output and coupled to the electric/acoustic transducer in this respect entails significant cleaning problems.

The European patent document 0,548,580 discloses using a membrane at the in-ear hearing aid to seal said housing, said membrane being coupled, as in the case of the actual loudspeaker diaphragm, with the loudspeakers motor drive. As a result the hearing aid design is comparatively more complex and so are the steps required to couple the said membrane to the loudspeaker drive and to assure that said membrane shall not be degraded by cleaning.

BRIEF SUMMARY OF THE INVENTION

The objective of the present invention is elimination of the above stated drawbacks of the known solutions and to propose an in-ear hearing aid of which the design shall fully meet the cleaning requirements in simple manner.

This goal of the invention is attained in that the acoustic output of the electric/acoustic transducer system at the in-ear hearing aid is separated by a freely vibrating membrane of said hearing aid from the hearing aid'environment.

It is the insight of the invention that by appropriately designing the acoustically effective spaces in the hearing aid and by appropriately controlling the membrane characteristics, acoustic impedance matching can be achieved so that such a freely vibrating membrane practically shall not affect the acoustic transfer function of the hearing aid at the output side of said transducer, that is, the said membrane shall be acoustically transparent.

Where desired, such a membrane also may be used as a damper.

In another preferred embodiment of the in-ear hearing aid of the invention, the freely vibrating part of the membrane is made of a single material, which preferably shall be elastomeric, for instance being latex or a silicone rubber. In a preferred embodiment, moreover, the membrane of the invention shall be of constant thickness at least within said vibrating part.

The cost of making the hearing aid is only trivially increased by introducing the above membrane. The preferably used membrane material, for instance latex or silicone, is highly economical and is manufactured in low, uniform thicknesses, it is stress-resistant and unobjectionable as regards making contact with living tissue.

In an especially preferred embodiment, the said membrane is mounted very close to the hearing-aid output, and as a result indentations and accumulations at the hearing aid that would raise cleaning difficulties are eliminated at least in the vicinity of said output. Moreover the acoustic output of the transducer system can be connected by a tube stub to the acoustic output aperture, however and in preferred manner, the acoustic output of the electric/acoustic transducer system shall be mounted in the direct vicinity of the output aperture of the hearing-aid housing.

In a further embodiment which is exceedingly advantageously with respect to hearing-aid manufacture, the hearing-aid output aperture consists by a lamellar sealing element connected to the remaining hearing-aid housing, for instance by welding or bonding. And in a further preferred manner, the membrane sealing the hearing-aid output aperture shall be integral with said sealing element, or it may be separate. Where desired the membrane may be slipped like a hose over the hearing-aid housing.

If the said sealing element is integral with the membrane, then the requirements relating of materials applying to the membrane also must apply to the sealing element. Preferably the said sealing element then shall be made of a elastomeric material, for instance latex or silicone.

The manufacturing method of the invention relating to the cited in-ear hearing aid furthermore is characterized by the statement of claim 9. Therein the transducer system is situated in a blind aperture in a support plate of which the base is formed by a membrane. Upon relative motion of support plate and hearing-aid housing, the transducer system then shall be inserted from the end constituting the acoustic output of the hearing-aid housing into this housing. Next the support plate is connected to the hearing-aid housing, for instance by bonding or welding, and thereafter the support plate is molded along the contour of the hearing-aid housing.

Such a procedure is extraordinarily well suited to automate the assembly of the in-ear hearing-aid housing and of the electric/acoustic transducer system as well as of the membrane.

In a preferred implementation of the manufacturing method of the invention, the membrane is integral with the support plate, this support plate preferably being made of a elastomeric material such as latex or silicone, or first the membrane in the form of a sheet and with apertures is deposited on the support plate and in this manner the blind apertures are formed first.

It has been conventional practice so far to manually carry out the assembly of in-ear hearing-aid housings and electric/acoustic transducer systems. Such a procedure eliminates the formation of acoustically shunting elements between the loudspeaker in the electric/acoustic transducer system and the hearing-aid housing whereby there would be feedback of the acoustic signals either directly or through the adjacent ear tissue into the acoustic/electric transducer at the input of the transducer system. Therefore, as already stated, the transducer system is manually inserted into the hearing-aid housing so as to be omnidirectionally spaced from it and to fix it in position therein.

In another aspect of the present invention, its objective is to substantially reduce the heretofore conventionally entailed cost of manufacture. This goal is attained basically by means of the statement of claim 12 in that the transducer system is inserted in automated manner into the hearing-aid housing. Compared with conventional procedure, wherein the transducer system is slipped from "above" into the hearing-aid housing, another and much preferred implementation of said manufacturing method of the invention inserts the transducer system through an aperture constituting the acoustic output of the hearing-aid housing into this housing. In a further much preferred implementation, the method of the invention is implemented in that the transducer system is positioned in a seating aperture of a support plate and then, on account of relative motion between the support plate and the hearing-aid housing, this transducer system is inserted from the end constituting the acoustic output of the hearing-aid housing into said housing. Especially as regards this further preferred implementation, whereby thereupon the support plate is joined to the hearing-aid housing, for instance by bonding or welding, and thereafter the support plate is contoured along the outer contour of the hearing-aid, the invention achieves positioning and affixing the transducer system in said support plate, as a result of which positioning the transducer system in the hearing-aid housing is reduced to the simple task of securing accurate advancing motions of hearing-aid housing and support plate. As already mentioned, such a procedure is ideal for automated assembly.

BRIEF DESCRIPTION OF THE DRAWINGS

The invention is elucidated below in relation to the attached Figures.

DETAILED DESCRIPTION OF THE PREFERRED EMBODIMENTS

Figure 1:
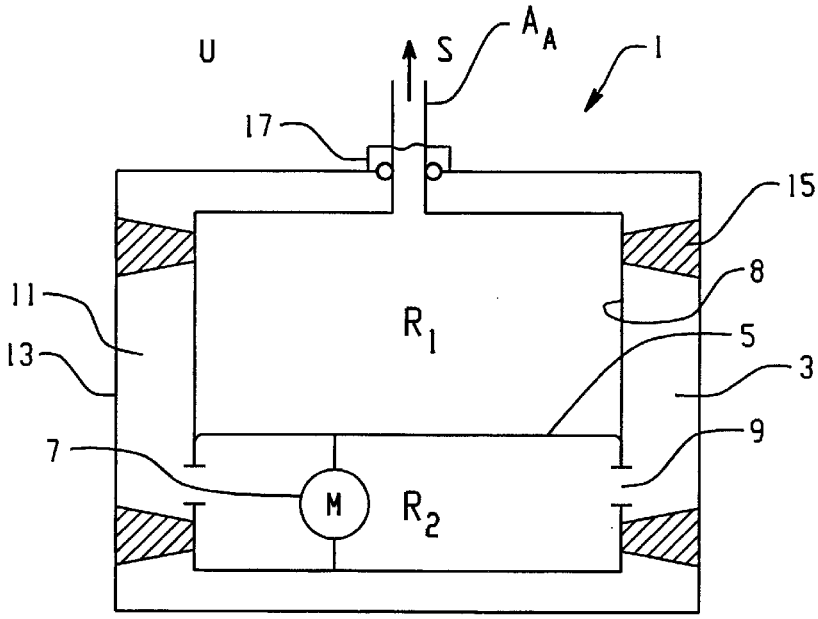
FIG. 1 diagrammatically shows a transducer system in the form of a module.

FIG. 1 diagrammatically shows a transducer module serving herein to elucidate the principles of acoustic coupling of this hearing aid. The transducer module 1 comprises a loudspeaker housing 3 wherein is supported the loudspeaker diaphragm 5. This loudspeaker diaphragm 5 is powered by a motor drive 7 merely indicated in schematic manner. The loudspeaker diaphragm 5 divides the loudspeaker housing 3 into a front chamber R1 and a rear chamber R2. One of the two cited chambers, for instance the rear chamber R2, is acoustically coupled through acoustic coupling apertures 9 with an acoustic gap 11 subtended between the loudspeaker housing 3 and the enclosure 13. The enclosure 13 and hence the gap 11 substantially entirely enclose the loudspeaker housing 3 except for elastic braces 15 by means of which the loudspeaker housing is spaced and supported in substantially "floating" manner within the enclosure 13. As shown in FIG. 1, the front chamber R1 communicates with the acoustic output $A_A$ of the transducer module 1.

In this design, on account of the substantially free-floating support of the loudspeaker housing 3 in the enclosure 13, the loudspeaker effect on the enclosure 13 is acoustically decoupled from this enclosure. By significantly enlarging the rear diaphragm chamber R2, namely by including the gap 11, the acoustic behavior of the transducer module 1 is significantly improved over that of the loudspeaker system in the housing 3: the bass of the transducer module is raised by several dB compared to the bass of the loudspeaker system in the housing 3.

In a preferred embodiment of the transducer module 1 invention, this very module shall be fitted with a membrane, as diagrammatically indicated by 17, at the acoustic output $A_A$. Except for being clamped at its rim, the membrane 17 is vibrates freely. Preferably this membrane is made of a homogeneous material, preferably a elastomeric material such as latex of silicone rubber, and in a further preferred manner, its thickness is constant and about 100 $\mu$, preferably no more than 0.09 mm.

By matching the acoustic impedance of the gap 11 to the chamber R2, of the chamber R1 as far as the membrane 17, of the membrane 17 and any acoustic conductor that might be provided to propagate toward the environment U of the transducer module 1, the membrane 17 is practically acoustically transparent.

Figure 2:
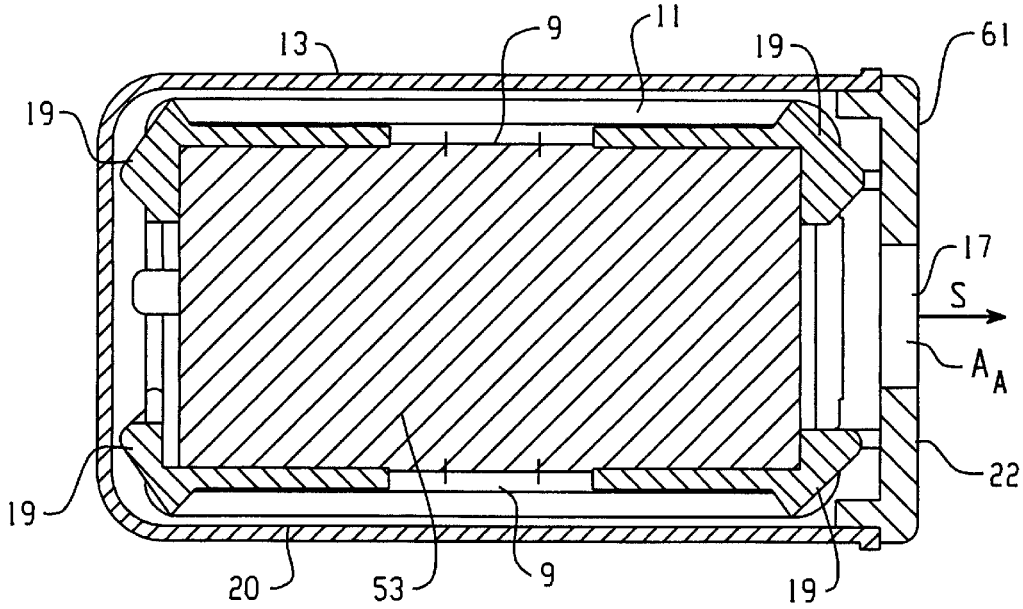
FIG. 2 is a diagrammatical simplification of a longitudinal section of one embodiment of a transducer system.

FIG. 2 is a cross-section of one embodiment of the transducer module 1. The references already used in the diagram of FIG. 1 are used herein also. The loudspeaker housing 3 comprising the coupling apertures 9 is supported by elastomeric bearings 19 on the enclosure 13. The enclosure 13 is constituted by a cup 20 preferably simultaneously acting as a magnetic shield and for that purpose preferably being made of mu-metal. In any event the cup 20 preferably shall be metallic. The cup 20 is sealed by a cover 22. The membrane 17 already shown in FIG. 1 may be mounted directly on the cover 22. Furthermore the cover 22 and the membrane 17 may very well be integral, in which case however the material of the cover 22 must meet the material requirements of the membrane, for instance regarding elastomeric behavior. Illustratively the entire component 22 shall be made of latex or silicone rubber. Otherwise the membrane 17 is anchored as a separate element on the cover 22. However the membrane 17 also may be fitted between the acoustic output $A_3$ in the loudspeaker housing 3 and the aperture in the cover 22. Preferably however, as shown in FIG. 2, the membrane 17 is trimmed to be flush with the aperture in the cover 22, whereby the transducer module 1 as a whole shall be a unit which is sealed and encapsulated per se and which can be cleaned very easily. Such a feature is especially significant if, as shall be discussed further below, the output $A_A$ of the transducer module 1 is situated directly at the acoustic output of a hearing aid.

Figure 2A:
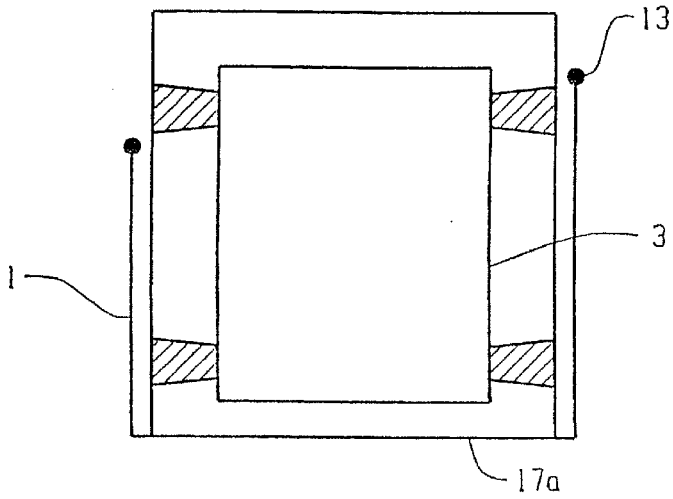
FIG. 2*a* is another diagrammatical embodiment of the transducer of FIG. 2 fitted with a membrane of the invention, FIG. 3 diagrammatically shows the installation of a transducer system into an in-ear hearing aid of the invention fitted with a membrane of the invention.

The transducer module, or its enclosure 13, can be cubic, cylindrical or assume another, arbitrary shape, provided that the required gap 11 substantially enclosing the loudspeaker housing 3 shall be subtended by the loudspeaker housing 3 and the enclosure 13. Based on the discussion relating to FIG. 2, FIG. 2*a* shows another embodiment, in merely diagrammatic form. Therein an elastomeric sleeve 17*a* is pulled over the enclosure 13. Said sleeve 17*a* simultaneously constitutes the cover 22 and the membrane 17.

Figure 3:
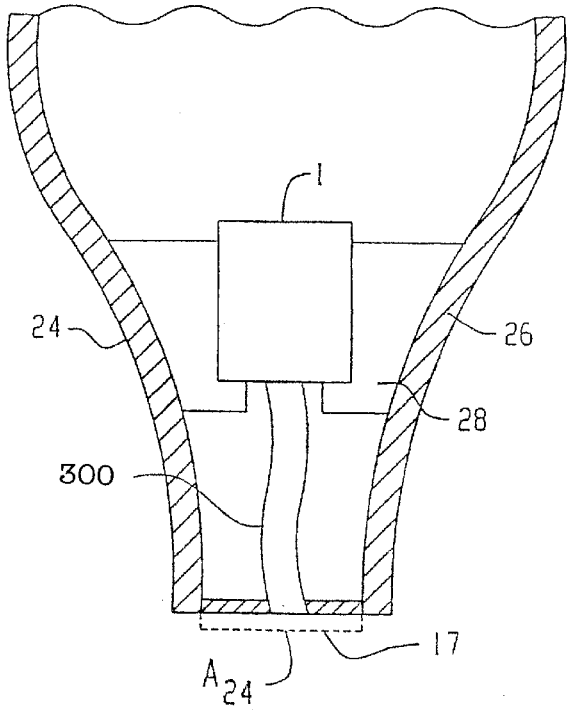

FIG. 3 diagrammatically shows the segment comprising the output aperture $A_{24}$ of an in-ear hearing aid 24. The transducer module 1 of FIG. 1, 2 or 2*a* is integrated into the hearing-aid housing 26, namely being situated and kept in position in frictionally or geometrically locking manner by means of straps 28, in the hearing-aid'housing 26. This feature is made possible by decoupling the enclosure 13 from the loudspeaker housing 3 in the transducer module in the manner discussed in relation to FIGS. 1, 2 and 2*a*. Otherwise the design of the in-ear hearing aid of FIG. 3 is substantially the same as the known designs because the acoustic output of the transducer module 1 is connected by a tubular stub 300 to the acoustic output aperture $A_{24}$ of the hearing aid.

The electronic components and the input-side acoustic/electrical transducer system at the in-ear hearing aid 24 comprising the housing 26 are omitted from FIG. 3 and the further Figures because not being essential to the invention.

As further shown in FIG. 3, the membrane 17 used in the preferred embodiments is integrated in the immediate vicinity of the acoustic output $A_{24}$ in the hearing-aid housing 26.

Figure 4:
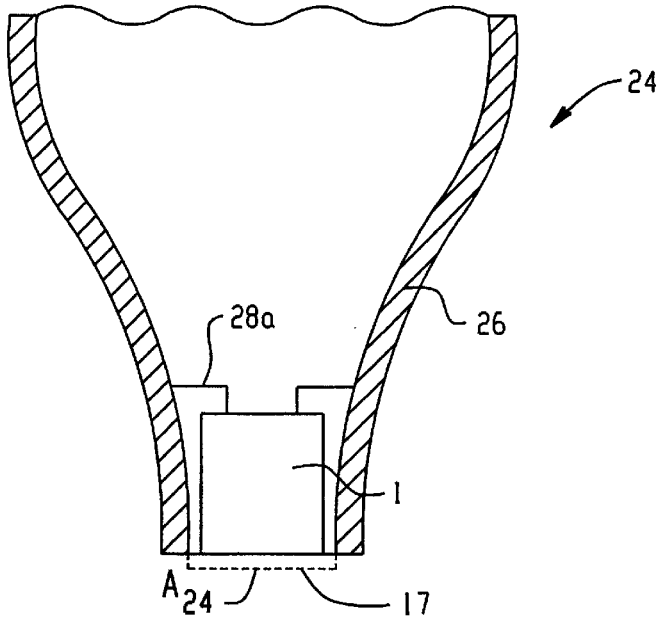
FIG. 4 is a view similar to FIG. 3 of a further possible integration of a transducer system fitted with the membrane of the invention into an in-ear hearing of the invention.

In FIG. 4, the transducer module 1 is mounted in frictionally or geometrically locking manner in the immediate vicinity of the acoustic output $A_{24}$ of the hearing aid 24, ie. of the housing 26 as indicated by the diagrammatically shown supports 28*a*. In a preferred embodiment mode, the freely vibrating membrane 17 is mounted terminally.

Figure 5:
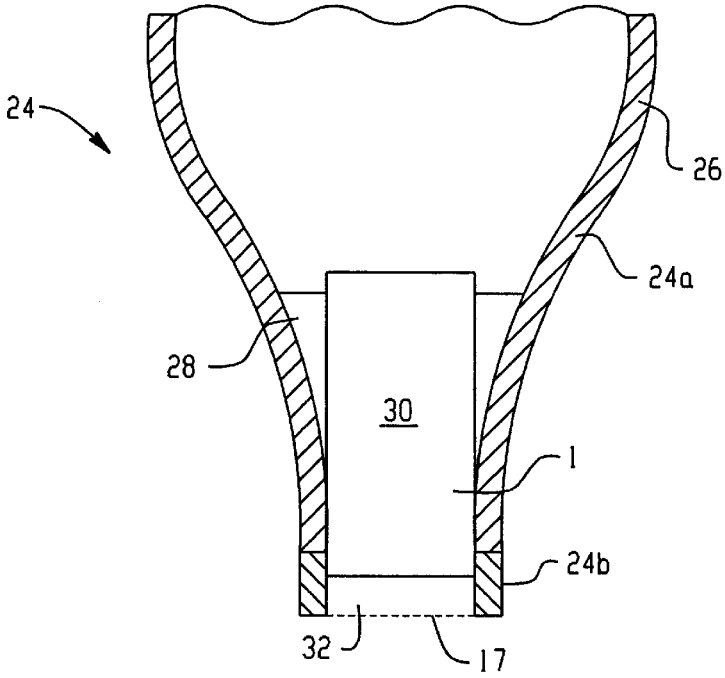
FIG. 5 is a view similar to FIG. 3 or FIG. 4 of a further preferred embodiment variation of that portion of an in-ear hearing aid which constitutes the acoustic output of the hearing aid, and FIGS. 6*a*–6*c* diagrammatically show the sequence of a manufacturing method of the invention applied to an in-ear hearing aid as regards assembling the electric/acoustic transducer system and the hearing-aid housing.

As shown in FIG. 5, the housing 26 of the in-ear hearing aid 24 consists of a main housing part 24*a*, whereas a laminar cover 24*b* is set terminally on the component 24*a* onto which it is bonded or welded. A transducer module 1 described in relation to FIGS. 1 and 2—or one fitted directly to the loudspeaker housing of a loudspeaker system of the prior state of the art, which in FIG. 5 includes both and is denoted by 30—is seated in the output aperture 32 of the cover 24*b* where it is affixed by clamping, bonding etc. If the transducer module 30 shown in generalized form in FIG. 5 is fitted with an enclosure, that is designed in the manner of FIGS. 1 and 2 or 2*a*, then the hearing-aid housing 26 may again contain positioning and affixation elements again denoted by 28 for said transducer module 1.

A preferred membrane of the above described kind is denoted by 17 also in FIG. 5 in a preferred position. As discussed further below, the design of FIG. 5, whether applied to hearing aids comprising a transducer module as shown in FIGS. 1, 2, 2*a* or whether applied to previously known transducer systems, that is with a loudspeaker housing directly on the outside, does offer substantial advantages. Moreover the membrane 17 may be integral with the component 24*b*, and in particular the material selection regarding the portion 24*b*, which is separate from the remaining housing 26, can be matched to the requirements placed on the membrane 17.

Figure 6A:
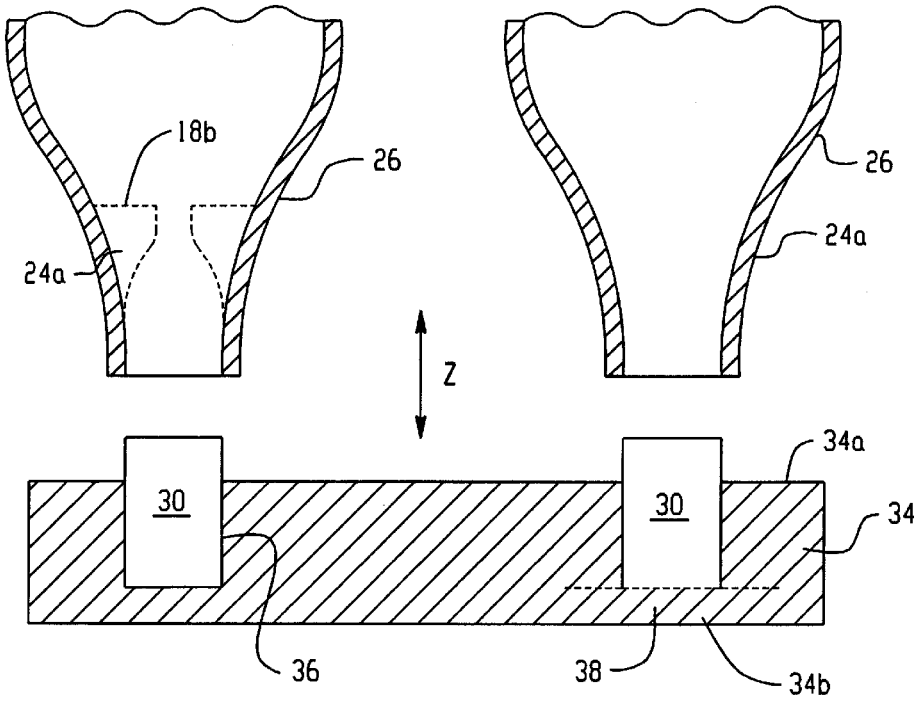
Figure 6B:
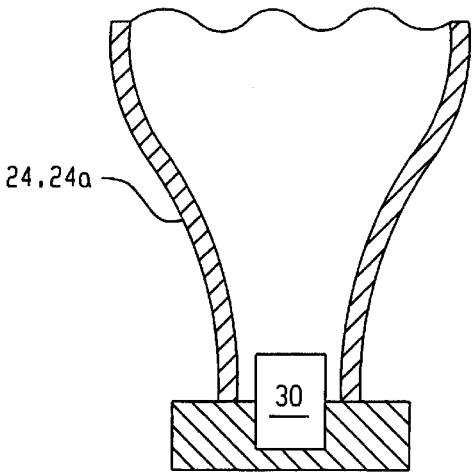
Figure 6C:
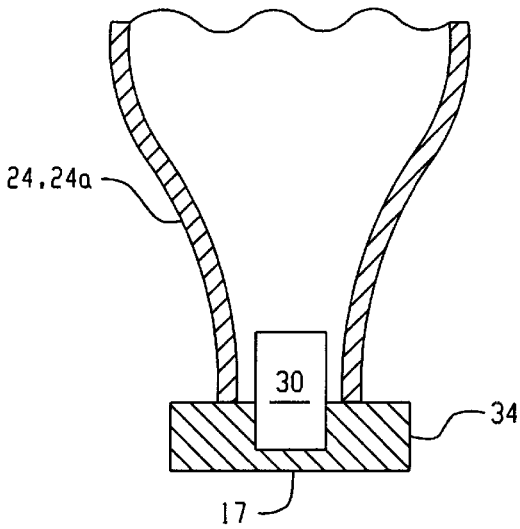

FIGS. 6*a* through 6*c* schematically show the sequence of a manufacturing method of in-ear hearing aids.

As shown in FIG. 6*a*, preferably blind apertures 36 are present in a support plate 34 and receive the transducer systems 30 of the in-ear hearing aids. If these transducer systems 30 are conventional, that is, if comprising an external loudspeaker housing and lacking an enclosure as shown in FIGS. 1, 2, 2*a*, then the transducer systems 30 preferably shall be firmly anchored in the support plate 34, for instance by bonding. If on the other hand the transducer systems do comprise external enclosures as shown in FIGS. 1, 2, 2*a*, then the systems 30 need not be kept firmly joined to the support plate 34, because, as already discussed and as shown at 28*b* in dashed lines, they may be affixed in frictionally or geometrically locking manner in the corresponding hearing-aid housings 24*a*. It is of foremost significance as regards the procedure that on account of relative motion of the plate 34 bearing the transducer systems 30 and a corresponding number of housing parts 24*a*, the transducer systems 30 shall not be inserted in the conventional manner from above, but instead from below into those segments of the housing parts 24*a* which face the acoustic output.

In case the transducer systems 30 are designed with enclosures, then, after the transducer systems 30 have been inserted in affixed manner into the housings 26, the support plate 34 may be removed, the transducer systems or modules being positioned and held in place in the housings 24*a*. On the other hand if transducer systems lacking an encapsulation enclosure are involved, the transducers 30 remain in the assigned apertures 36 of the plate 34. The plate 34 is connected to the housing 24*a* for instance by bonding or welding, and, based on the position of FIG. 6*b*, the plate 34 then is trimmed to become flush with the external housing contour (transition to FIG. 6*c*).

The result is the in-ear hearing aid shown in FIG. 5. However this procedure is preferred for transducer modules designed in the manner of FIGS. 1, 2, 2*a*, that is fitted with an enclosure.

Observation of FIG. 6 shows that this procedure is unusually well suited to integrate the membrane 17 or another preferred one to act both as soil protection for the acoustic hearing-aid output and as a means assuring simple cleaning. For that purpose the base plate 38 of FIG. 6*a* of the apertures 36, which preferably shall be blind holes, shall be directly formed as the membrane. Implementation takes place either by selecting the material of the support plate 34 to match the requirements set on the membrane material and hence designing integrally with the plate 34, or, as shown in dashed lines in FIG. 6*a*, by forming the blind holes 36 first by laminating the support plate 34, the apertures still being open end to end, with a sheet 34*b* or the like which then constitutes the membrane 17 of FIG. 5.

The above discussed manufacturing method allows assembling both transducer modules as shown in FIGS. 1, 2, 2*a* and also conventional transducer systems, that is comprising an external loudspeaker housing, in the in-ear hearing aid housing, without need for laborious positioning maneuvers. Said assembly can be implemented from that side where the acoustic output is situated. As a result substantially automated assembly is made possible. If, as preferred, the acoustic hearing-aid output shall be protected against soiling from the environment, and allow good cleaning, it is also simultaneously feasible to integrate a covering membrane 17 as discussed above.

What is claimed is:

1. A hearing device comprising:

a hearing aid housing including a wall with an inner surface and with an outer surface facing towards a surrounding of said device;

a transducer including an encapsulation, said encapsulation comprising either a part of said wall or having an encapsulation wall portion being mounted along a section of said wall;

an opening from the inside of said encapsulation through said wall;

wherein said part of said wall or said encapsulation wall portion has a freely vibrating portion, and wherein said opening establishes acoustical communication between the inside of said encapsulation and the surrounding of said hearing device and wherein said opening is covered by said freely vibrating portion.

2. The device of claim 1, wherein said part or wall portion consists of a single material.

3. The device of claim 1, wherein part or wall portion is comprised at least in part of a rubber elastic material, and further wherein said part or wall portion is removably applied to said part by elastically slipping said membrane over said part.

4. The device of claim 1, wherein said freely vibrating portion is integral with said part or wall portion.

5. The device of claim 1, wherein said vibrating portion and said wall consist of the same material.

6. The device of claim 1, wherein said vibrating is elastic.

7. The device of claim 1, wherein said vibrating portion is of substantially constant thickness.

8. The device of claim 7, wherein said constant thickness is at most 0.09 mm.

9. The device of claim 1, wherein said vibrating portion is mounted by welding or bonding.

10. A hearing device comprising:

a hearing device housing including a part;

a transducer with an acoustical port communicating with a surrounding of said device via an acoustical opening in said part;

a freely vibrating membrane covering said opening and being removably applied and elastically held to said part by elastically slipping said membrane over said part.

11. The device of claim 10, wherein said freely vibrating membrane consists of a single material.

12. The device of claim 10, wherein said freely vibrating membrane comprises elastomeric material.

13. The device of claim 10, wherein a freely vibrating portion of said membrane is of constant thickness.

14. The device of claim 13, wherein said constant thickness is at most 0.09 mm.

15. The device of claim 10, wherein said membrane is mounted by welding or bonding.

16. The device of claim 10, wherein said membrane is comprised at least in part of a rubber elastic material.

17. The device of claim 10, wherein said membrane is integral with said part.

18. A hearing device comprising:

a hearing device housing including a wall with an inner surface and with an outer surface facing towards a surrounding of said device, said housing forming a first opening;

an encapsulation within said housing for encapsulating a transducer, said encapsulation being mounted to said inner surface of said wall and forming a second opening, wherein said second opening communicates with said first opening; and;

a part including a freely vibrating membrane at least substantially in plane with said outer surface of said wall, wherein said first and said second openings establish acoustical communication between an inside of said encapsulation and the surrounding of said hearing device, and wherein said first opening is covered by said freely vibrating membrane, and wherein said part is in direct contact or integral with said encapsulation.

19. The device of claim 18, wherein said membrane is comprised at least in part of a rubber elastic material.

20. The device of claim 18, wherein said freely vibrating membrane is of constant thickness.

21. The device of claim 20, wherein said constant thickness is at most 0.09 mm.

22. The device of claim 18, wherein said membrane is mounted by welding or bonding.

23. A hearing device comprising:

a hearing device housing including a wall with an inner surface and with an outer surface facing towards a surrounding of said device;

a transducer;

an encapsulation for encapsulating said transducer, said encapsulation being mounted to said inner surface of said wall and forming an opening from an inside of said encapsulation through said wall; and a part including a freely vibrating membrane at least substantially in plane with said outer surface of said wall, wherein said opening establishes acoustical communication between the inside of said encapsulation and the surrounding of said hearing device and wherein said opening is covered by said freely vibrating membrane, and wherein said part is in direct contact or integral with said encapsulation.

24. The device of claim 23, wherein said part is comprised at least in part of a rubber elastic material.

* * * * *

UNITED STATES PATENT AND TRADEMARK OFFICE

CERTIFICATE OF CORRECTION

PATENT NO. : 6,879,696 B1
DATED : April 12, 2005
INVENTOR(S) : Andi Vonlanthen

It is certified that error appears in the above-identified patent and that said Letters Patent is hereby corrected as shown below:

Column 1,
Line 36, please delete "aid'", and insert therefor -- aid's --.

Column 4,
Line 10, please delete "is", (first occurrence).
Line 12, please delete "of", and insert therefor -- or --.
Line 63, please delete "aid", and insert therefor -- aid's --.

Column 6,
Lines 4 and 5, please delete the word "encapsulation".

Column 7,
Lines 28-29, please delete claim number "15".
Lines 32-33, please delete claim number "17".

Signed and Sealed this

Fifteenth Day of November, 2005

JON W. DUDAS
*Director of the United States Patent and Trademark Office*